United States Patent [19]

Holland

[11] 3,956,807

[45] May 18, 1976

[54] JET APPARATUS FOR FORWARDING AND ENTANGLING TOW

[75] Inventor: Kenneth W. Holland, Kingsport, Tenn.

[73] Assignee: Eastman Kodak Company, Rochester, N.Y.

[22] Filed: May 2, 1975

[21] Appl. No.: 574,066

[52] U.S. Cl. ..... 28/1.4

[51] Int. Cl.[2] ..... D02G 1/16

[58] Field of Search ..... 28/1.3, 1.4, 72.12; 57/34 B, 157 F; 226/7, 97; 34/23; 239/398; 302/25, 63

[56] References Cited

UNITED STATES PATENTS

| | | | |
|---|---|---|---|
| 3,259,952 | 7/1966 | Caines | 28/1.4 |
| 3,673,648 | 7/1972 | Thacker | 28/1.4 |
| 3,727,275 | 4/1973 | Ohayon | 28/1.4 |
| 3,729,831 | 5/1973 | Kosaka et al. | 28/1.4 X |
| 3,832,759 | 9/1974 | Eskridge et al. | 28/1.3 |
| 3,849,844 | 11/1974 | Bauch et al. | 28/1.3 |
| 3,852,857 | 12/1974 | Ethridge et al. | 28/1.3 |

*Primary Examiner*—Louis K. Rimrodt
*Attorney, Agent, or Firm*—Malcolm G. Dunn; Daniel B. Reece, III

[57] ABSTRACT

Jet apparatus for forwarding tows, yarns, rovings or like yarn bundles by gasiform stream flows, the apparatus including a first jet device having a first passageway and a first gasiform stream flow for moving a multi-filament tow along the passageway through the jet device by tension exerted on the tow by the first gasiform stream flow, a second jet device downstream of the first jet device and having a second passageway and a second gasiform stream flow for flow into the second passageway and onto the tow at about right angles to the direction of tow movement through the second passageway for cohesively entangling the tow with some of the second gasiform stream flow passing upstream of the tow movement into conflict with the first gasiform stream flow, and an elongated enclosure having a passageway connecting the passageways of the first and second jet devices and defining through its wall a predetermined number of spaced perforations through which a portion of the conflicting first and second gasiform stream flows exhaust laterally from the connecting passageway and from the path of the tow.

6 Claims, 3 Drawing Figures

JET APPARATUS FOR FORWARDING AND ENTANGLING TOW

BACKGROUND OF THE INVENTION

This invention is directed to a jet apparatus for forwarding tows, yarns, rovings or like yarn bundles by means of a gasiform stream flow, and particularly to a jet apparatus for forwarding a multi-filament tow along a desired path, as for forwarding or pulling tow into a box, baler or can.

In the textile industry it is common to collect multi-filament yarn tow in cans for subsequent withdrawal from a series of such cans to join together and form a larger tow for suitable processing, such as for the processing operations of drafting, crimping, and cutting into staple fibre.

The spinning of such multi-filament tows from suitable polymers occur from spinning cabinets, which are often on one floor, while the various spinning cabinet "ends" or yarn ends from a row of such cabinets are collected together and puddled into a collecting receptacle located on a lower floor, such as a "can" for later withdrawal for the purpose previously indicated.

The processing speed at which the various spinning cabinets may extrude filaments is determined by a number of factors. Obviously, however, any one obstacle or retarding agency along the line will necessarily govern the actual speed at which the spinning cabinets are operated, despite their possible potential for greater extrusion rates.

One possible obstacle can be the apparatus employed to puddle the collected cabinet yarn ends into a can. The Morehead et al patent, U.S. Pat. No. 3,281,913, discloses a jet puddling apparatus which is employed to puddle such collected spinning cabinet yarns ends into a rectangular container or what will hereinafter be referred to as a "can". This patent was selected because of its illustrated disclosure of a series of spinning cabinets, with the cabinet yarn ends being conjoined for travel over a feed roll to a jet puddler apparatus. The jet puddler apparatus, in turn, is connected to a traverse mechanism by which the tow is caused to be deposited in the rectangular can in longitudinal and transverse motions.

One problem often encountered with the use of a traverse mechanism, such as the one shown in the Morehead et al patent, is the possibility of the tow undesirably becoming wrapped around the feed or puddler roll, necessitating a shut-down of the tow processing equipment until the roll wrap can be removed. The roll wrap is often caused by the loss of tension on the tow at the feed or puddler roll. Since the feed or puddler rolls(s) is moving the tow at one rate of speed, when the traverse mechanism moves the puddler apparatus toward the extreme ends of its travel, a sharp snubbing angle is created by the tow at the inlet of the jet puddler apparatus. The tow being snubbed or rubbed against the jet puddler inlet is thus retarded in speed while the feed or puddler roll rate has not been similarly retarded. This, then, results in the tension loss because of a decrease in the tow pulling power of the jet puddler apparatus.

Another problem occurs as a consequence of the spinning cabinets being located on one floor and the tow cans being located on the lower floor or a lower level. The jet puddler apparatus and its traverse mechanism, such as the one shown in the Morehead et al patent, are also located on the lower level just above the can top. When it becomes necessary, for whatever reason, to rethread the tow into the jet puddler apparatus, the spinning floor operator must signal the operator on the lower floor so that the tow can be passed to the lower floor operator for the thread-up operation. Sometimes it may be several minutes before the lower floor operator can be reached. In the meantime, the spinning cabinets continue to operate at speeds in excess of 1000 meters per minute, with the result that the collected cabinet yarn ends must go to a waste receptacle until the thread-up operation can be achieved.

The present invention enables the spinning floor operator to thread the jet puddler apparatus himself, thus minimizing the amount of waste created, by moving the jet puddler apparatus up to an opening in the spinning room floor where the spinning floor operator can readily reach it.

The present invention also eliminates the necessity for use of an involved traverse mechanism, such as the one shown in the Morehead et al apparatus, by adapting the jet puddler apparatus to oscillate in such compound directions as to form complete tow bed layers in the can. The sharp break or snubbing angle is thus significantly reduced to minimize any possible loss of tension and hence possible reduction in the pulling power of the jet puddler apparatus.

Oscillating puddling apparatus is not new, as they have been used before. In moving the jet puddler apparatus to a position higher above the can, the tow has a greater distance to travel, and to overcome the effect of gravity the gasiform stream flow used to entrain the tow through the jet puddler apparatus must be increased in order to assure that the tow layers extend to all sides of the can. A problem with increased stream flow is that the gas, usually air, tends to spread the filaments of the tow outwardly from each other, so that they tend to splash and bounce about in the can upon contact with the previously puddled layers. This will tend to create a withdrawal problem later when an attempt is made to remove the tow in an orderly manner for subsequent processing. Another problem associated with increased gasiform stream flow pressure is that the tow being puddled tends to be driven toward the previously puddled tow layers below with such force as to cause interfilament penetration of one layer with another. This also creates a withdrawal problem.

The present invention minimizes this problem by puddling the tow in an entangled manner so as to maintain a relatively cohesively formed bundle of multi-filaments, and at the same time reduces the amount of excess gas, such as air, in the can to minimize possible splashing and bouncing about of the tow layers being puddled.

SUMMARY OF THE INVENTION

The present invention, therefore, is directed to an improved apparatus for forwarding multi-filament tow wherein a first jet device has a first passageway and a first gasiform stream flow for moving the incoming tow along a path in the passageway in the apparatus by tension exerted on the tow by the first gasiform stream flow, a second jet device downstream of the first jet device has a second passageway and a second gasiform stream flow for flow into the second passageway and onto the tow at about right angles to the direction of tow movement through the second passageway for cohesively entangling the tow as the tow moves along the path through the apparatus with some of the second gasiform stream flow passing upstream of the two movement into conflict with the first gasiform stream flow, and an elongated enclosure surrounding the path between the first and second jet devices and having a passageway connecting the passageways of the first and second jet devices and enabling a portion of the conflicting first and second gasiform stream flows to exhaust laterally from the connecting passageway and from the path of the tow.

The improved jet apparatus may not only be used as a tow puddler apparatus, but may also be used in other yarn bundle processing locations for the purpose of forwarding a multi-filament yarn bundle where and when it is desired that the yarn bundle be moved and retained in a relatively cohesive form.

DESCRIPTION OF THE PREFERRED APPARATUS

Figure 1:
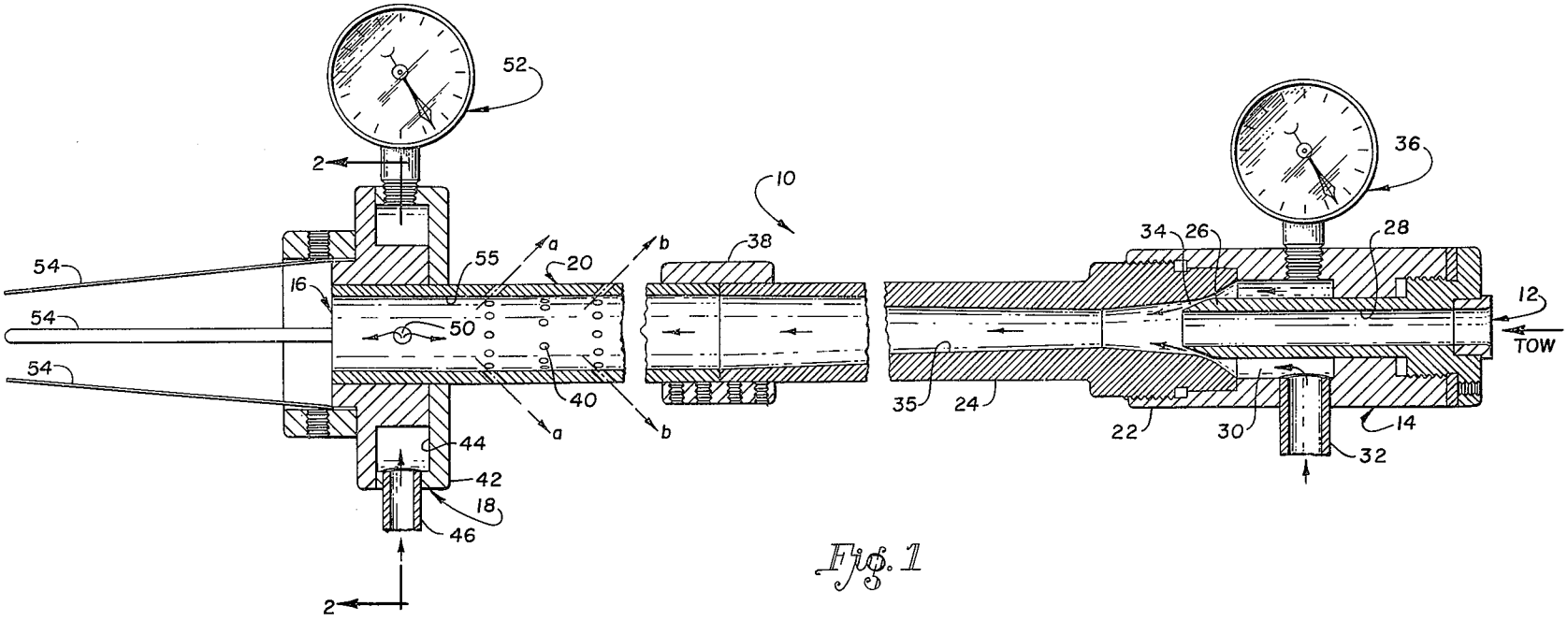
FIG. 1 discloses in cross-section an elevation of the jet apparatus for forwarding multi-filament yarn bundles.

In reference to the drawings, the improved apparatus for forwarding multi-filament tow and other yarn bundles is shown in general at 10. The apparatus comprises adjacent the tow inlet end 12 a first jet device 14, adjacent the tow outlet 16 a second jet device 18 and an elongated enclosure 20, which is preferably perforated in a predetermined manner and is connectedly intermediate the first and second jet devices.

The first jet device comprises a housing 22; a tailpipe 24 and a nozzle 26, each threadingly engaged with the housing 22. A passage 28 extends through the nozzle from the inlet end 12 and is of substantially uniform diameter. The housing defines an annular chamber 30 for receipt of a gasiform stream flow through the supply conduit 32. The annular chamber is located in the first jet device between the outer cylindrical surface of the nozzle 26 and the adjacent internal surface of the housing 22. The annular chamber opens into a throat 34 formed between the conical portion of the nozzle 26 and the adjacent flared out surface of the tailpipe 24. A gasiform stream flow is thus continuously directed into a venturi-like passage, which commences at the throat 34, and continues along the interior or passageway 35 of the tailpipe, which passageway is tapered and increases in size or diameter along the length of the tailpipe. The nozzle is adjustable relative to the adjacent flared out surface of the tailpipe 24 to affect the clearance distance in the throat 34.

The gage shown at 36 may be used as an indicator to the operator for adjusting the gasiform stream flow through the first jet device 14.

The end of the tailpipe 24 of the first jet device may be suitably coupled to an elongated enclosure 20 by means of a connector sleeve 38.

The elongated enclosure 20 is preferably formed from a cylindrical tube, and a series of spaced perforations 40 are formed to extend through the wall of the tube. Preferably, there are five (s) rows of ten holes each, with each row being staggered from an adjacent row. The drawing only illustrates three rows of perforations because a portion of the length of the cylindrical tube is broken away.

The perforations 40 are so formed that their axes, as shown for example at *a*, *b*, extend at less than right angles with respect to the outer wall surface of the cylindrical tube in a direction toward upstream of the path.

The second jet device 18 is connected to the end of the cylindrical tube or elongated enclosure 20, and comprises a housing 42, which defines therewithin an annular plenum chamber 44. The annular plenum chamber receives therewithin a gasiform stream flow of a suitable gas, such as air, through the supply conduit 46 for subsequent flow around the plenum chamber and into the opposed conduit passages 48, 50, which serve to direct opposed gasiform stream flows into the passageway 55 of the cylindrical tube at about right angles against a tow, which would be passing therethrough, in an entangling manner.

The gage shown at 52 may also be used as an indicator to the operator for adjusting the gasiform stream flow through the second jet device.

A series of spring fingers 54 may optionally be provided at the outlet 16 of the apparatus for a safety purpose to be described later.

Figure 3:
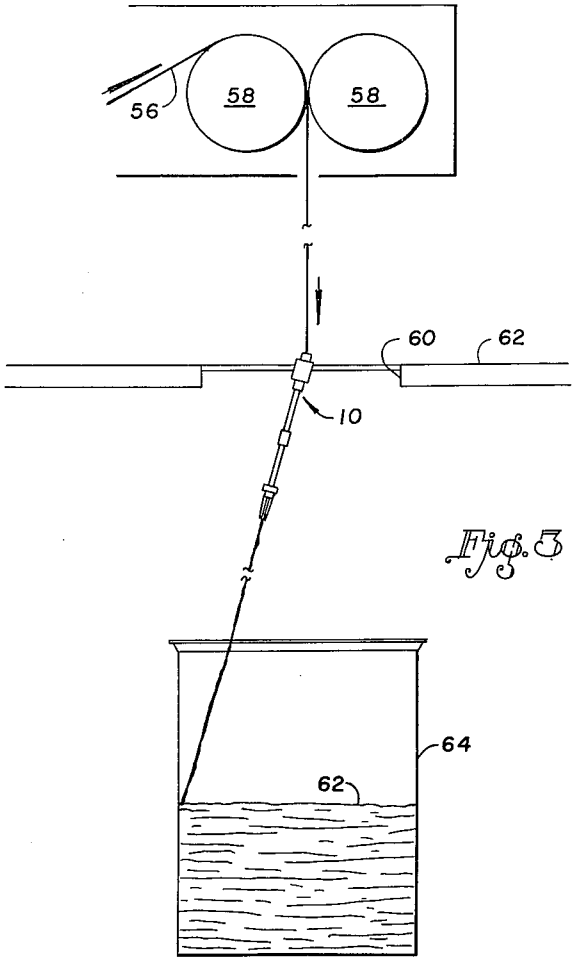
FIG. 3 is a diagrammatic view in elevation of the jet apparatus, shown in FIG. 1, being employed as an oscillating jet puddler apparatus for puddling tow into a can.

In operation, the tow 56 (FIG. 3) may be fed to the tow forwarding apparatus 10 by feed or puddler rolls 58 which are driven at a predetermined rate of rotation. The tow passes down between the rolls to the jet appartus 10, which is shown mounted at the opening 60 in the upper floor level 62, which represents for purposes of illustration the spinning cabinet floor level. The mechanism for causing the jet apparatus to puddle is not shown, but would be suitably connected to the upper end of the jet apparatus. The tow passes through the apparatus 10 and is puddled in layers 62 within the can 64.

Figure 2:
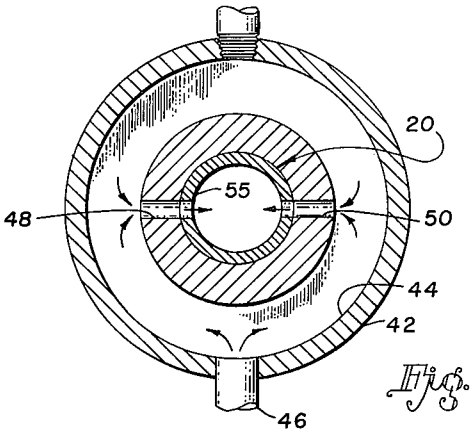
FIG. 2 is a view in cross-section taken along line 2—2 of the plenum chamber of the apparatus of FIG. 1.

In reference specifically to FIGS. 1 and 2, the arrows in the passageways of the jet apparatus 10 indicate the general directions of the gasiform stream flows. The gasiform stream flow through the first jet device 14 serves to entrain and forward the tow along a desired path through the apparatus. The gasiform stream flows from the second jet device onto the tow serve to entangle the tow somewhat and form it into a more cohesive bundle. Some of the flow from the second jet device passes upstream into conflict with the stream flow from the first jet device. A portion of the conflicting combined gasiform stream flows is exhausted through the perforations formed in the elongated enclosure or cylindrical tube. The axes of the perforations are formed in the angular manner that is shown at *a* and *b*, for instance, to prevent the possibility of stray filaments being undesirably exhausted outwardly therethrough.

In the event that a roll wrap, for whatever reason, should occur at the feed or puddler rolls 58, the tow would tend to be pulled back through the jet apparatus from out of the can. The spring fingers serve a safety purpose by catching and resistingly engaging the tow against being pulled back through the jet apparatus, and thereby cause the tow to break. The fingers are so adjusted that they do not normally impede the tow in its flow therepast into the can.

The use of the perforated cylindrical tube or elongated enclosure was found to increase the amount of entanglement occurring in the tow.

It is thought that the reason for this improvement occurs as a result of tension fluctuations, or plucking of the filaments as the tow passes alternately by the perforated and non-perforated areas between the perforations. It is well known that entangling processes are enhanced by reduced tensions. As previously indicated, the perforated section also dissipates the amount of gasiform stream flow or air blast into the can, and thus reduces disturbance of the tow layers in the can.

An example of one operation is as follows:

1.5 denier per filament yarn was spun from 824 hole jets in sixteen cabinets at 1300 meters per minute. The first jet device had a yarn bore that was 5/16 inch; the second jet device had a yarn bore of 0.81 inch, and gasiform stream flow conduit bores of 0.173 inch. The first jet device was operated at a jet pressure of 45–50 PSIG and the second jet device was operated at a jet pressure of 55–60 PSIG. Gas (air) consumption of the second jet device at 58 PSIG waS measured to be 26 CFM (57.8 SCFM). Samples of the tow produced were tested by the hook drop method and found to have about 0.5 inch average entanglement spacing. The appearance of the tow in the can seemed to be characterized by a more bulked and loopy appearance. Tow withdrawal from the can did not appear to present any problems.

Although the invention has been described in considerable detail with particular reference to certain preferred embodiments thereof, variations and modifications can be effected within the spirit and scope of the invention.

I claim:

1. Apparatus for forwarding a multi-filament tow comprising:

a first jet device defining therewithin a first passageway, and having means for introducing a first gasiform stream flow through the first jet device along the first passageway for moving the tow along a path through the passageway by tension exerted on the tow by the first gasiform stream flow;

a second jet device spaced from the first jet device and defining therewithin a second passageway for the path of the multi-filament tow, and having means for introducing a second gasiform stream flow onto the tow across the second passageway at about right angles to the direction of tow movement for cohesively entangling the multi-filament tow as the tow moves along the path with some of the second gasiform stream flow passing upstream of the tow movement into conflict with the first gasiform stream flow from the first jet device; and means connectedly interposed between the first and second jet devices and defining therewithin a connecting passageway from the first jet device paasageway to the second jet device passageway and defining means for enabling a portion of the conflicting gasiform stream flows from the passageways of the first and second jet devices to exhaust laterally from the connecting passageway and from the path of the tow.

2. Apparatus as defined in claim 1, wherein the first jet device is a puddling jet device, and the second jet device is an entangling jet device, and the means connectedly interposed between the first and second jet devices is an elongated enclosure defining through its wall a predetermined number of spaced perforations through which the portion of the first and second gasiform stream flows exhaust laterally from the path.

3. Apparatus as defined in claim 2, wherein the elongated enclosure is a cylindrical tube, and the perforations are so formed that their axes extend at less than right angles with respect to the outer wall surface of the cylindrical tube in a direction toward upstream of the path.

4. Apparatus as defined in claim 1, wherein the second jet device is an entangling filament jet device comprising means defining a closed annular plenum chamber encircling the passageway of the second jet device, a pair of opposed conduits opening out at their outer ends to the annular plenum chamber and at their opposite ends to the passageway of the second jet device adapted for conducting therethrough gasiform stream flows for intersection with the tow on either side of the path, and a supply conduit connected to the annular plenum chamber for suplying therethrough to the annular plenum chamber the second gasiform stream flow.

5. Apparatus as defined in claim 1, wherein the first jet device is a puddling jet device comprising a nozzle defining therewithin a portion of the passageway of the first jet device, the nozzle being tapered at its outlet end, means defining an annular chamber encircling the nozzle and also defining a supply conduit opening into the annular chamber for supplying therethrough to the annular chamber the first gasiform stream flow; and a tailpipe of predetermined length defining another portion of the passageway of the first jet device, the taper of the passageway portion increasing in size in the direction of tow movement along the path, and also defining at its inlet end a bore having a greater taper than that of the tapered nozzle outlet end and adapted to receive closely therewithin, but spaced from the tapered surface thereof, the tapered nozzle end; and wherein the means connectedly interposed between the first and second jet devices is connected at the end of the tailpipe.

6. Apparatus as defined in claim 1, wherein the first jet device is a puddling jet device having a tailpipe of predetermined length, the tailpipe defining therewithin a tapered passageway which increases in size in the direction of path movement, and wherein the means connectedly interposed between the first and second jet devices is connected at the end of the tailpipe.

* * * * *